US010024247B2

(12) United States Patent
Ting et al.

(10) Patent No.: US 10,024,247 B2
(45) Date of Patent: Jul. 17, 2018

(54) ENGINE BRAKE LEVER

(71) Applicant: Cummins Inc., Columbus, IN (US)

(72) Inventors: Darren Ting, Columbus, IN (US); David M. Barnes, Columbus, IN (US)

(73) Assignee: Cummins Inc., Columbus, IN (US)

( * ) Notice: Subject to any disclaimer, the term of this patent is extended or adjusted under 35 U.S.C. 154(b) by 49 days.

(21) Appl. No.: 15/081,493

(22) Filed: Mar. 25, 2016

(65) Prior Publication Data

US 2016/0281613 A1 Sep. 29, 2016

Related U.S. Application Data

(60) Provisional application No. 62/138,212, filed on Mar. 25, 2015.

(51) Int. Cl.

| | |
|---|---|
| ***F02D 13/04*** | (2006.01) |
| ***F01L 13/06*** | (2006.01) |
| ***F01M 9/10*** | (2006.01) |
| ***F01L 1/053*** | (2006.01) |
| ***F01L 1/18*** | (2006.01) |

(52) U.S. Cl.

CPC ..... *F02D 13/04* (2013.01); *F01L 1/053* (2013.01); *F01L 1/18* (2013.01); *F01L 1/181* (2013.01); *F01L 13/06* (2013.01); *F01M 9/108* (2013.01); *F01L 2001/0537* (2013.01); *F01L 2105/00* (2013.01)

(58) Field of Classification Search

CPC ... F02D 13/04; F01L 13/06; F01L 1/18; F01L 1/181; F01M 9/108

USPC ..... 123/321, 320

See application file for complete search history.

(56) References Cited

U.S. PATENT DOCUMENTS

| | | | | |
|---|---|---|---|---|
| 6,213,091 | B1 * | 4/2001 | Haugen | F01L 1/26 123/321 |
| 6,234,143 | B1 * | 5/2001 | Bartel | F01L 13/06 123/321 |
| 6,257,201 | B1 * | 7/2001 | Kajiura | F01L 13/06 123/321 |
| 6,439,195 | B1 * | 8/2002 | Warner | F01L 13/06 123/320 |
| 2011/0203549 | A1 | 8/2011 | Schnell | |
| 2013/0269652 | A1 | 10/2013 | Toth et al. | |
| 2014/0251266 | A1 | 9/2014 | Emmons et al. | |

* cited by examiner

*Primary Examiner* — Mahmoud Gimie

(74) *Attorney, Agent, or Firm* — Faegre Baker Daniels LLP

(57) ABSTRACT

A valve train assembly is provided, comprising an exhaust camshaft having an exhaust lobe and a brake lobe, an exhaust lever mounted adjacent the exhaust lobe, a brake lever mounted adjacent the brake lobe, wherein the exhaust lever is coupled to the brake lever to provide simultaneous movement of the exhaust lever and the brake lever in response to the exhaust lobe and independent movement of the brake lever in response to the brake lobe.

20 Claims, 11 Drawing Sheets

ENGINE BRAKE LEVER

PRIORITY CLAIM

This application claims priority to U.S. Provisional Application No. 62/138,212, which is entitled "ENGINE BRAKE LEVER," and was filed on Mar. 25, 2015, the entire disclosure of which is expressly incorporated herein by reference in its entirety.

TECHNICAL FIELD

The present invention relates generally to engine brakes, and more particularly to a master-slave driven brake lever system for an internal combustion engine that satisfies two engine operations with just two rocker levers and provides an oil-pressure drive brake tappet system that enables activation of the braking system while not sacrificing the required exhaust function.

BACKGROUND

Pre-existing approaches to engine braking require additional components, as well as additional machining processes related to the cam lobe profiles. The additional braking rocker and lobe used in conventional systems also take up axial space along the camshaft which is sometimes required for future technologies, such as axial cam shifting or other variable valve train actuation. Some approaches use an additional braking rocker arm and an additional braking lobe.

The typical engine braking functionality is achieved by adding a third rocker arm as well as a third cam lobe to the valve train system. In such a case, the system would comprise two exhaust rocker arms, two exhaust lobes, one exhaust braking arm, and one braking lobe. An improved system with fewer components and more compact design is needed.

SUMMARY

The present disclosure provides a system including only one exhaust lever, one exhaust lobe, one brake lever, and one braking lobe, because the brake lever replaces one of the exhaust levers. More specifically, when the engine is operating in a normal mode, the exhaust lobe of the exhaust camshaft actuates the exhaust lever. The exhaust lever is coupled to the brake lever such that when the exhaust lever moves to actuate its corresponding exhaust valve, the brake lever also moves and actuates its corresponding exhaust valve. In other words, both the exhaust lever and the brake lever follow the exhaust lobe during normal operation. During engine braking operating, the brake lever follows the brake lobe of the exhaust camshaft and operates independent of the exhaust lever to actuate its corresponding exhaust valve.

In one embodiment, the present disclosure provides a valve train assembly, comprising an exhaust camshaft having an exhaust lobe and a brake lobe; an exhaust lever mounted adjacent the exhaust lobe; and a brake lever mounted adjacent the brake lobe, wherein the exhaust lever is coupled to the brake lever to provide simultaneous movement of the exhaust lever and the brake lever in response to the exhaust lobe and independent movement of the brake lever in response to the brake lobe. In one aspect of this embodiment, the brake lever comprises a coupling having an inner surface and the exhaust lever is coupled to the brake lever when a component of the exhaust lever engages the inner surface. In a variant of this aspect, the brake lever follows motion of the exhaust lever during engine operation based on the component of the exhaust lever engaging the inner surface of the coupling. In another variant of this aspect, engagement of the component with the inner surface of the coupling permits the brake lever to move in tandem with the exhaust lever in response to a roller of the exhaust lever engaging the exhaust lobe.

In a variant of this variant, disengagement of the inner surface of the coupling with the component causes the exhaust lever to remain stationary and permits the brake lever to move independent of the exhaust lever in response to a tappet assembly of the brake lever engaging the brake lobe. In another aspect of this embodiment, the brake lever comprises a housing and a lower clevice that forms an oil cavity with the housing, the lower clevice providing an oil drain. In a variant of this aspect, the brake lever further comprises a tappet assembly that moves to activate the brake lever in response to oil in the oil cavity exceeding a threshold level. In variant of this variant, the housing comprises a coupling that engages a pin of the exhaust lever to actuate an exhaust valve and provide an engine braking function based on activation of the brake lever. In another variant of this aspect, the tappet assembly comprises a roller and a roller pin having an opening that provides lubricant to the roller, the lubricant permitting smooth rotation of the roller upon engagement of the roller with the brake lobe.

In another embodiment, the present disclosure provides a valve train assembly, comprising an exhaust lever mounted adjacent an exhaust lobe; and a brake lever mounted adjacent a brake lobe, the brake lever comprising a tappet assembly; wherein the exhaust lever couples to the brake lever to provide simultaneous movement of the exhaust lever and the brake lever in response to rotation of the exhaust lobe; and wherein the brake lever moves independent of the exhaust lobe in response to a roller of the tappet assembly engaging the brake lobe. In one aspect of this embodiment, the brake lever further comprises a housing and a coupling that projects from the housing, and the exhaust lever couples to the brake lever based on engagement with the coupling. In a variant of this aspect, the exhaust lever comprises a pin that extends and projects from the exhaust lever toward the brake lever and engages an inner surface of the coupling. In a variant of this variant, engagement of the pin with the inner surface of the coupling permits the brake lever to move in tandem with the exhaust lever in response to a roller of the exhaust lever engaging the exhaust lobe. In another variant of this variant, the exhaust lever remains stationary when the inner surface of the coupling is disengaged from the pin such that the brake lever moves independent of the exhaust lever in response to the roller engaging the brake lobe. In another variant of this aspect, the brake lever comprises a housing and a lower clevice that forms an oil cavity with the housing, and wherein the tappet assembly activates the brake lever in response to oil in the oil cavity exceeding a threshold level.

In yet another embodiment, the present disclosure provides a method, comprising mounting an exhaust lever adjacent an exhaust lobe of an exhaust camshaft; mounting a brake lever adjacent a brake lobe of the exhaust camshaft, the brake lever comprising a tappet assembly; engaging a component of the exhaust lever with a coupling of the brake lever to simultaneously move the exhaust lever and the brake lever in response to rotation of the exhaust lobe; and independently moving the brake lever relative to the exhaust lever in response to a roller of the tappet assembly engaging the brake lobe. In one aspect of this embodiment, engaging a component of the exhaust lever with a coupling of the brake lever to simultaneously move the exhaust lever and the brake lever causes actuation of at least two exhaust valves in response to rotation of the exhaust lobe. In another aspect of this embodiment, independently moving the brake lever relative to the exhaust lever comprises disengaging the coupling of the brake lever from the component of the exhaust lever. In yet another aspect of this embodiment, the brake lever further comprises a housing and a lower clevice that forms an oil cavity with the housing, and wherein the roller of the tappet assembly engages the brake lobe and activates the brake lever in response to oil in the oil cavity exceeding a threshold level. In a variant of this aspect, the method further includes, activating an engine braking function of the valve train assembly in response to the tappet assembly being moved to a braking positioning in response to application of a hydraulic force to the lower clevice.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
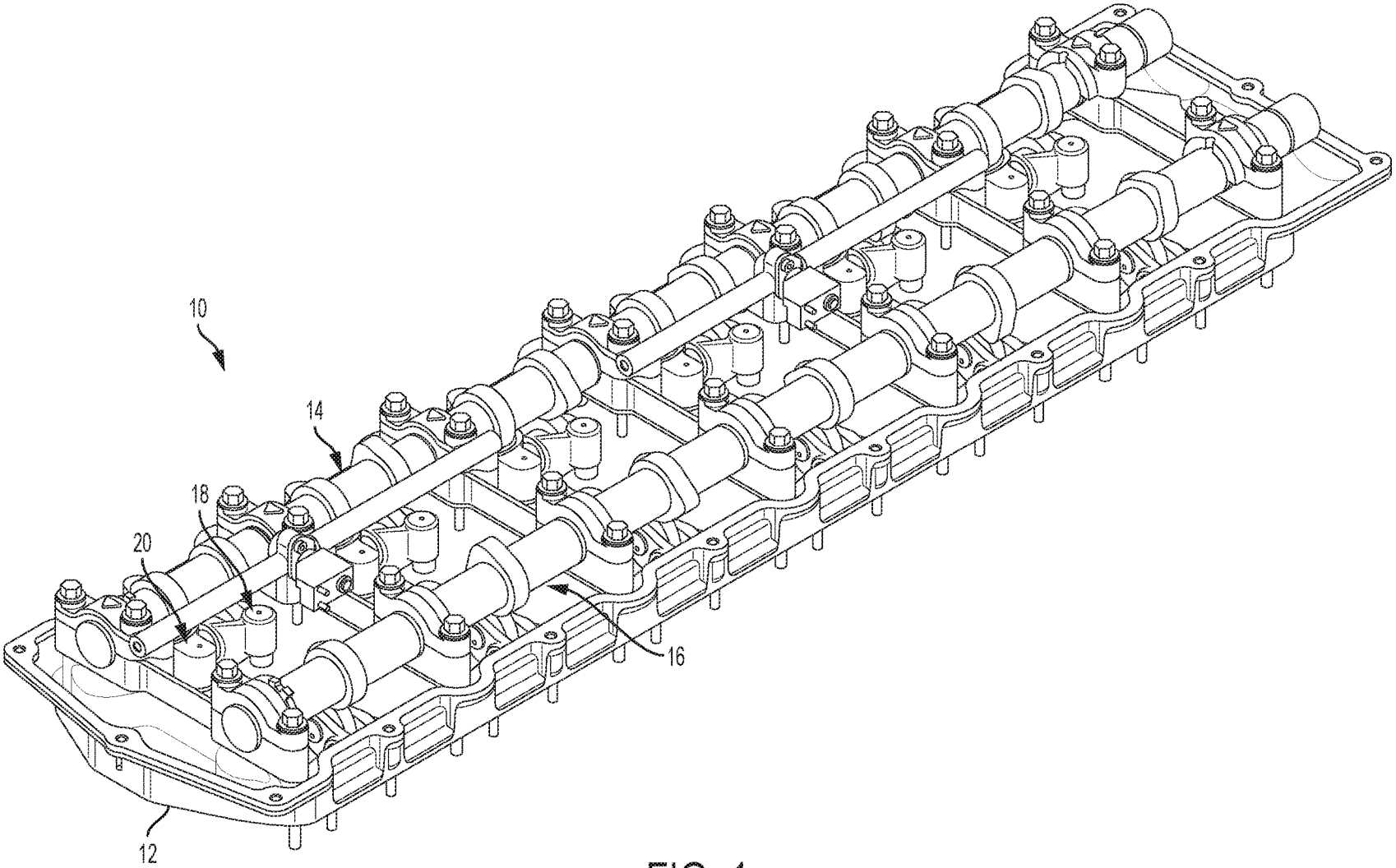
FIG. 1 is a perspective view of a valve train assembly according to the principles of the present disclosure.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

Figure 2:
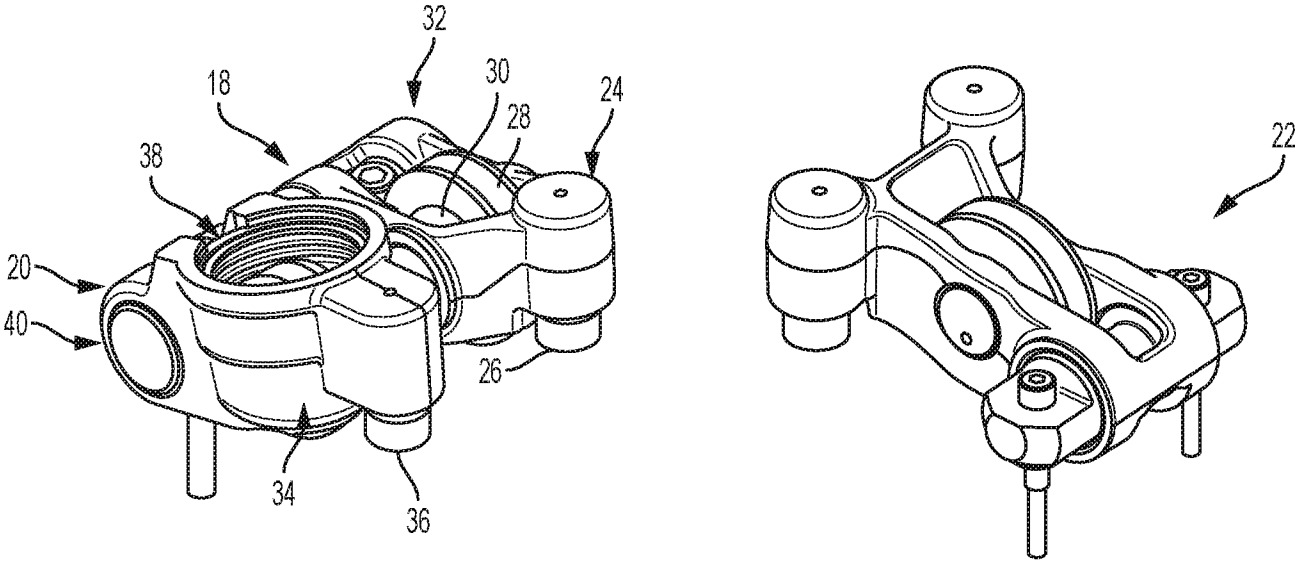
FIG. 2 provides perspective views of an exhaust lever, a brake lever and an intake lever according to one embodiment of the present disclosure.

Referring now to FIG. 1, a valve train assembly 10 according to one embodiment of the present disclosure is shown including a cam carrier 12, an exhaust cam 14, an intake cam 16, a plurality of exhaust levers 18, a plurality of brake levers 20, and a plurality of intake levers 22 (shown in FIG. 2). As shown in FIG. 2, exhaust lever 18 generally includes a housing 24 having a valve actuator 26, a roller 28 that rotates on a roller pin 30, and a pivot end 32 that pivots about a shaft as exhaust lever 18 is moved by contact of roller pin 30 with an exhaust lobe of exhaust cam 14 as is further described below. Brake lever 20 similarly includes a housing 34 having a valve actuator 36, a tappet assembly 38, and a pivot end 40 that pivots about a shaft as brake lever 20 is moved by contact of tappet assembly 38 with a brake lobe of exhaust cam 14 or as a result of movement of exhaust lever 18 as is further described below.

Figure 3:
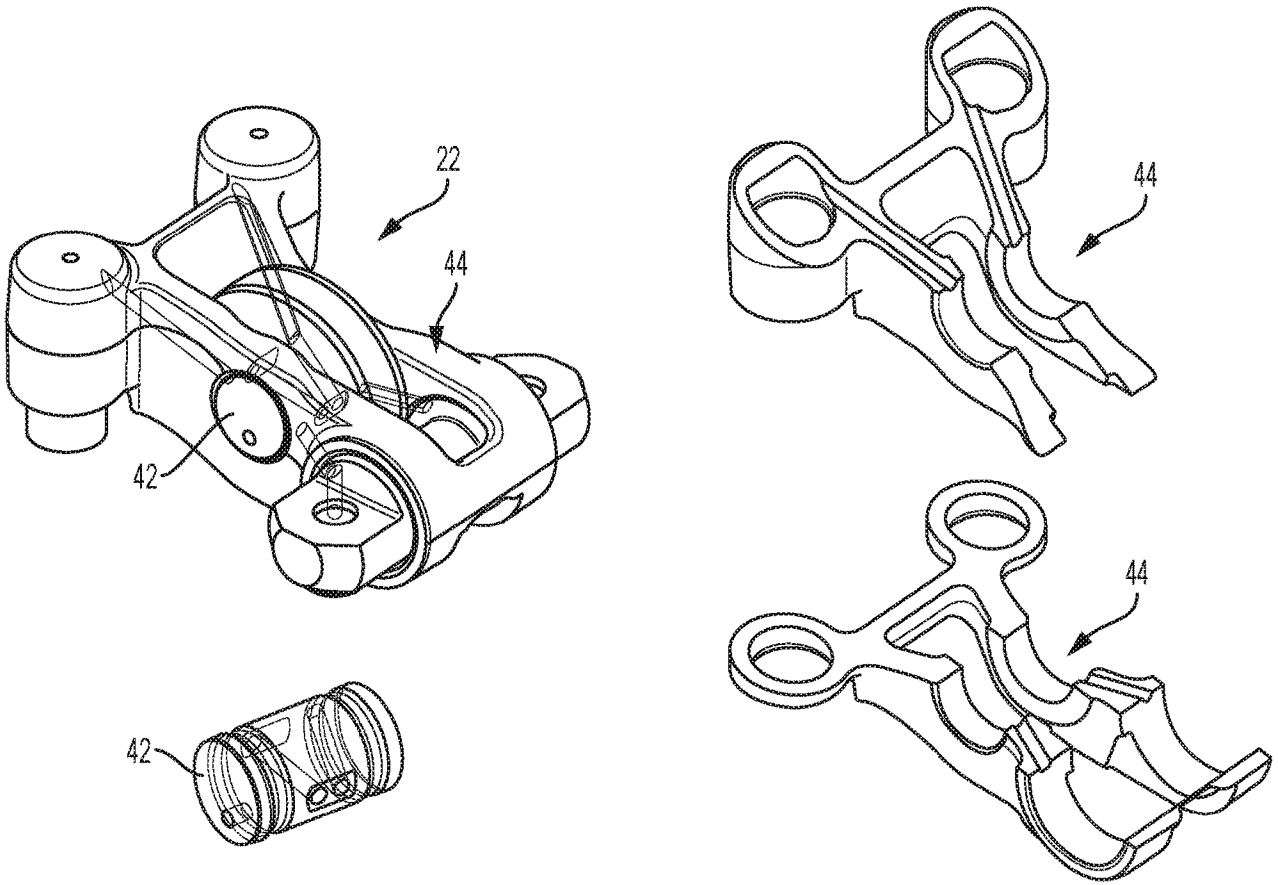
FIG. 3 provides various perspective views of the intake rocker of FIG. 2.

FIG. 3 includes a perspective view of intake lever 22 (upper left corner), a perspective view of the roller pin 42 of intake lever 22 (lower left corner) and sectional views of the housing 44 of intake lever 22 (right hand side) showing the drillings for delivering oil to a hydraulic lash adjuster ("HLA").

Figure 4B:
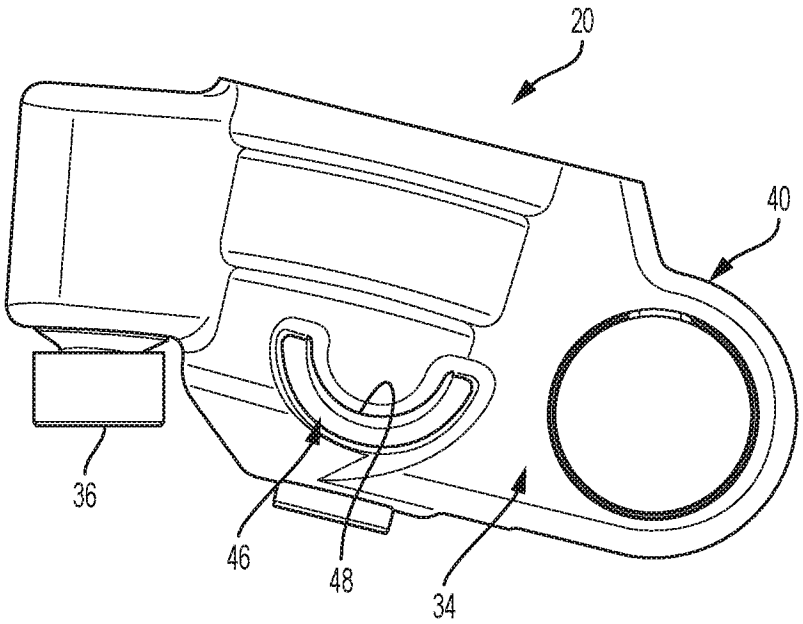
FIG. 4B is a side view of the brake lever of FIG. 2.
Figure 4A:
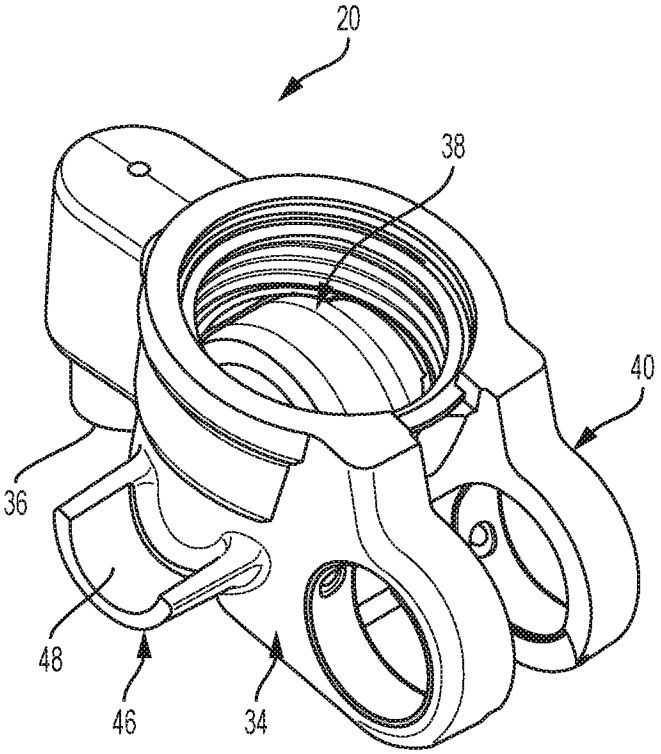
FIG. 4A is a perspective view of the brake lever of FIG. 2.

FIGS. 4A and 4B provide perspective and side views, respectively, of brake lever 20 according to one embodiment of the present disclosure. As shown, in addition to housing 34, valve actuator 36, tappet assembly 38 and pivot end 40, brake lever 20 includes a coupling 46 projecting from housing 34. In this embodiment, coupling 46 has a semi-circular cross-section and an inner surface 48 that is engaged by a component of exhaust lever 18 to cause brake lever 20 to follow motion of exhaust lever 18 during operation as is further described below. In one embodiment, brake lever 20 may further include a lever stop (not shown) that prevents over-extension of tappet assembly 38 and/or over-extension of one or more components of tappet assembly 38.

Figure 5B:
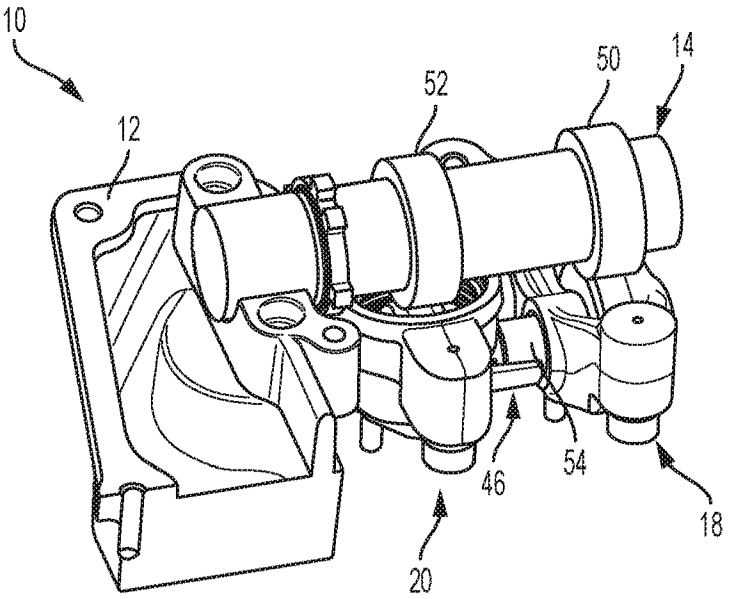
FIGS. 5A-B are perspective views of the valve train assembly of FIG. 1.
Figure 5A:
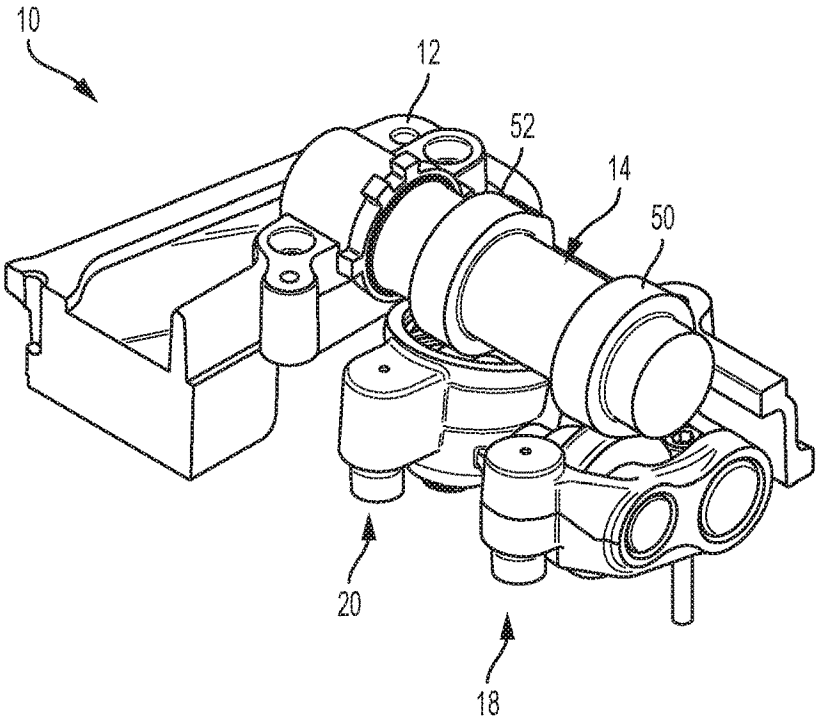

FIGS. 5A and 5B show perspective views of portions of valve train assembly 10 including exhaust lever 18 and brake lever 20. As best shown in FIG. 5B, exhaust lever 18 is mounted adjacent an exhaust lobe 50 of exhaust cam 14 and brake lever 20 is mounted adjacent a brake lobe 52 of exhaust cam 14. Exhaust lever 18 includes an extended roller pin 54 which projects from exhaust lever 18 toward the adjacent brake lever 20 and seats against inner surface 48 of coupling 46 of brake lever 20. As is further explained below, the engagement of extended roller pin 54 with coupling 46 permits (1) brake lever 20 to move in tandem with exhaust lever 18 (and perform the function of an exhaust lever) in response to engagement of exhaust lever roller 28 with exhaust lobe 50, and (2) brake lever 20 to move independent of exhaust lever 18 (and perform the function of a brake lever) in response to engagement of brake lever tappet assembly 38 with brake lobe 52. As such, using only one exhaust lobe 50, two exhaust valves may be actuated.

Figure 6B:
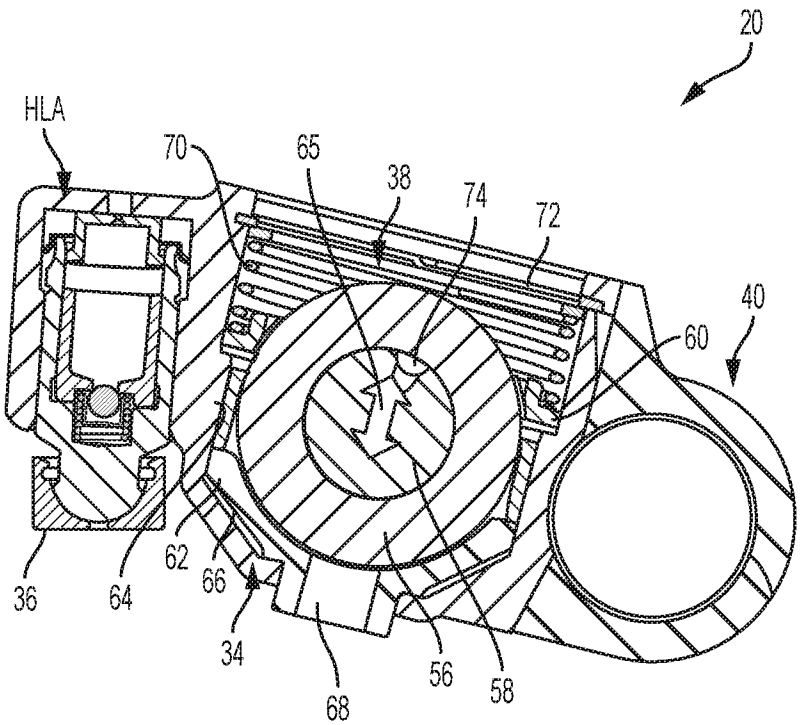
FIG. 6B is a cross-sectional view of the brake lever of FIG. 6A.
Figure 6A:
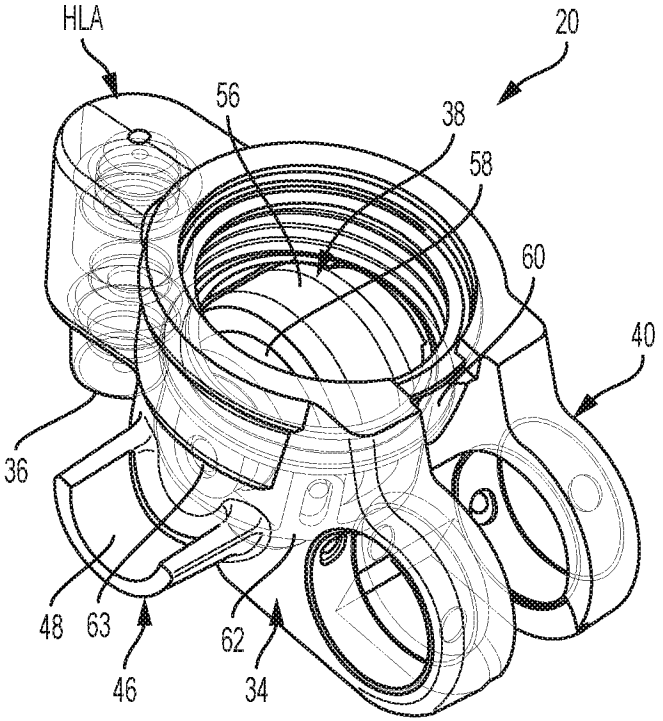
FIG. 6A is a perspective view of a brake tappet assembly mounted within the brake lever of FIG. 2.

FIG. 6A shows brake lever 20 in phantom to better depict brake tappet assembly 38 mounted within brake lever 20.

Figure 6C:
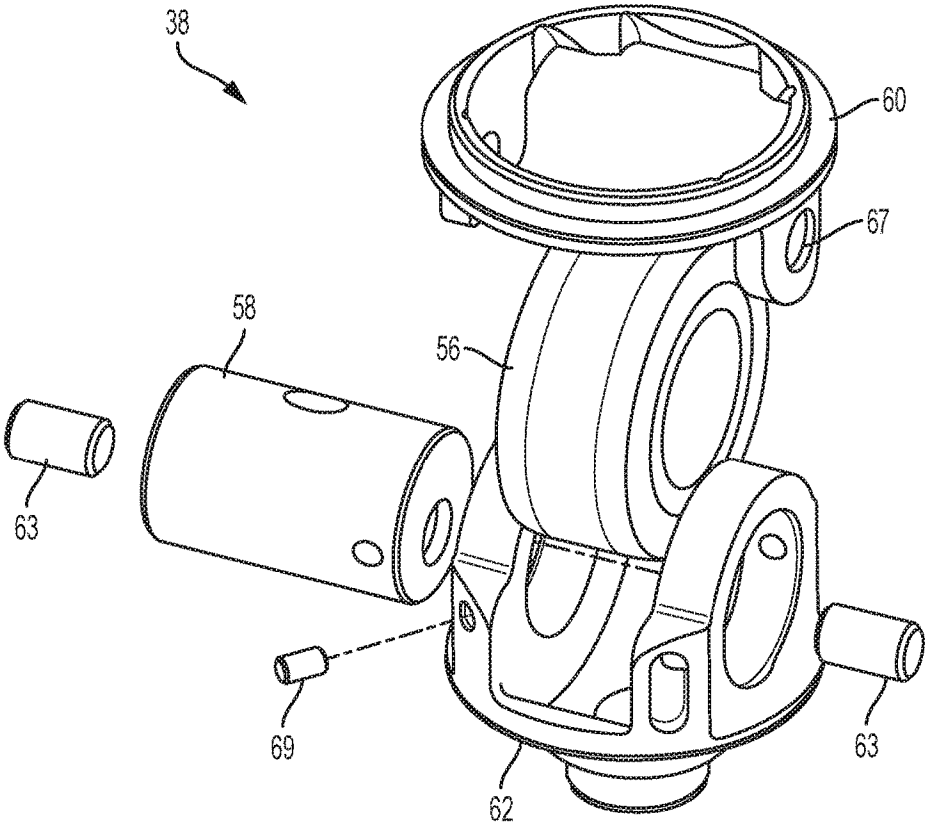
FIG. 6C is an exploded, perspective view of a tappet assembly according to one embodiment of the present disclosure.

FIG. 6B is a cross-sectional view through the center of brake lever 20 which depicts internal portions of brake lever 20 as described below. FIG. 6C is an exploded view of tappet assembly 38. Referring to all three figures, tappet assembly 38 generally includes a roller 56 mounted on a roller pin 58 captured within an upper clevice 60 and a lower clevice 62, which are held together by a dowels 63 (FIGS. 6A and 6C) which extend through openings 67 formed through upper clevice 60 into roller pin 58. Tappet assembly 38 is movable (as indicated by arrow 65 in FIG. 6B) along a longitudinal axis of a bore 64 formed within housing 34. An anti-rotation pin 69 (FIG. 6C) extends from lower clevice 62 into a slot (not shown) formed into housing 34 to maintain tappet assembly 38 (and particularly roller 56) in alignment with brake lobe 52 as tappet assembly 38 is moved between a normal mode to a braking mode as further described herein. Lower clevice 62 forms an oil cavity 66 with housing 34 and provides an oil drain 68. In one embodiment, brake lever 20 may include a check valve system (not shown) configured to prevent backflow of oil. For example, the check valve system may be configured to prevent oil back flow relative to oil cavity 66 so that back flow does not occur when oil is fed or pumped to oil cavity 66. Tappet assembly 38 is biased downwardly by a spring 70 which is retained within bore 64 by retaining clips 72. The HLA of brake lever 20 is also shown in the figures. Opening 74 of roller pin 58 provides lubricant to roller 56 to permit smooth rotation upon engagement with brake lobe 50.

Figure 7:
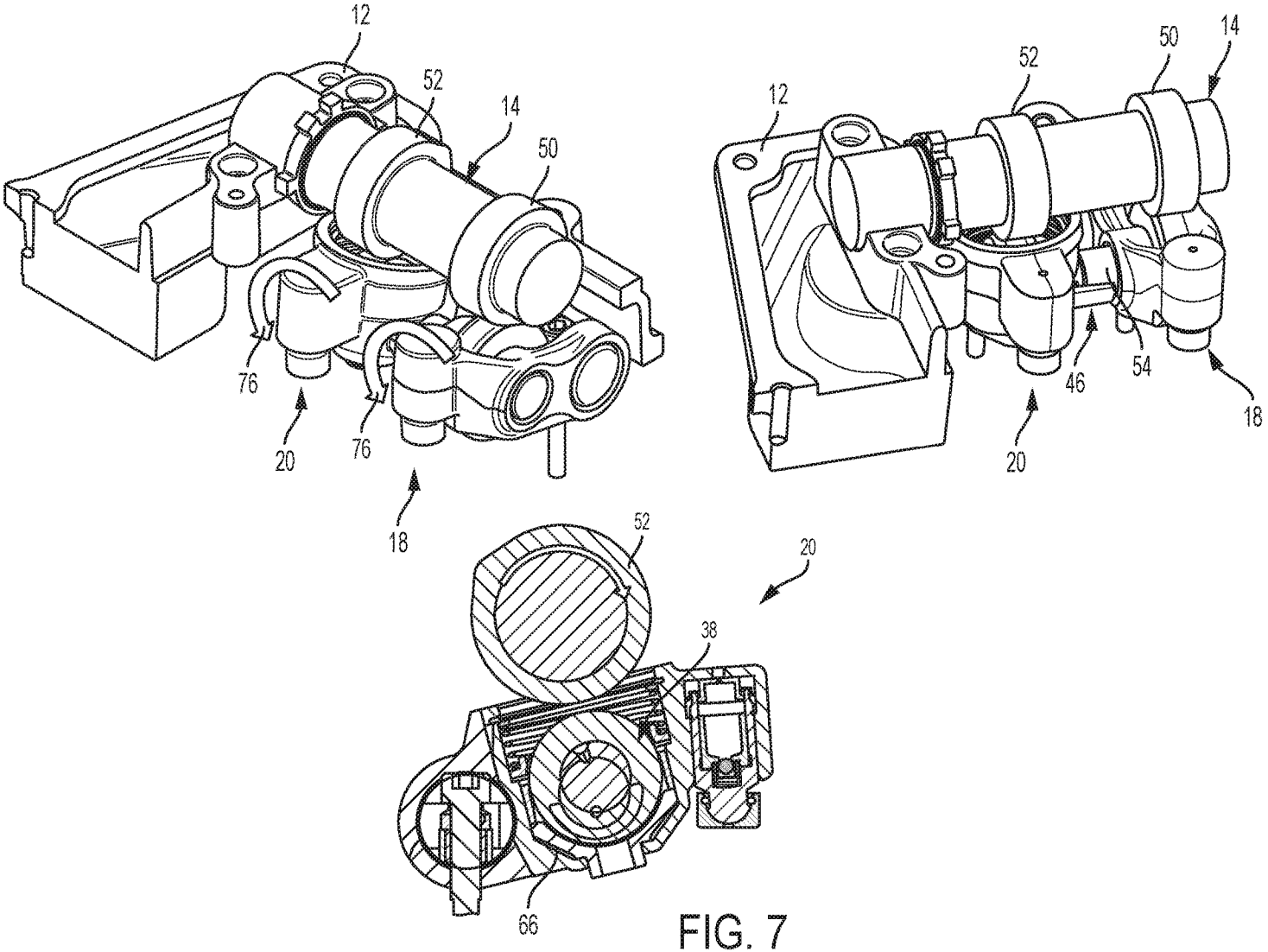
FIG. 7 provides various views of the valve train assembly of FIG. 1 operating in normal mode such that the brake lever and the exhaust lever move together.

FIG. 7 depicts brake lever 20 and exhaust lever 18 during normal engine operation. In this mode, oil is not fed to oil cavity 66 and tappet assembly 38 remains in its inactive position below brake lobe 52. However, when exhaust lever 18 is actuated by exhaust lobe 50, extended roller pin 54 moves downwardly with exhaust lever 18, thereby forcing coupling 46 (and brake lever 20) downwardly such that exhaust lever 18 and brake lever 20 simultaneously actuate their respective exhaust valves. This simultaneous movement is indicated by arrows 76 in the upper left corner of FIG. 7.

Figure 8B:
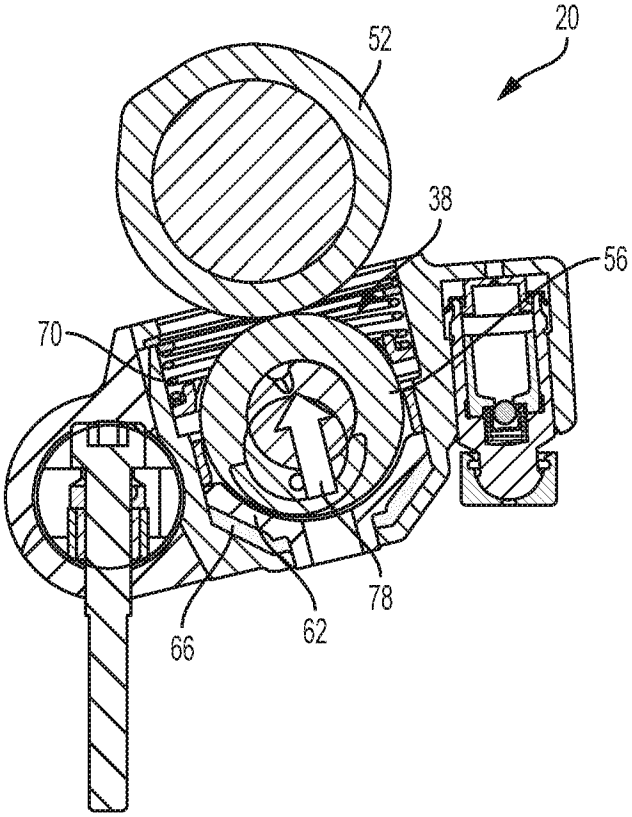
FIG. 8B is a cross-sectional view of the brake lever of FIG. 7 in a braking mode.
Figure 8A:
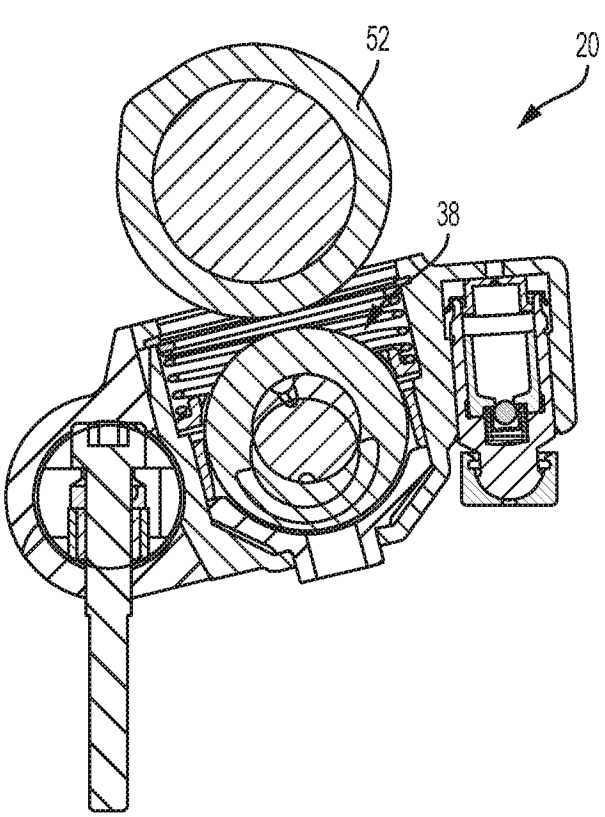
FIG. 8A is a cross-sectional view of the brake lever of FIG. 7 in a normal mode.

FIG. 8A is a cross-sectional view of braking lever 20 in normal, inactive mode, wherein tappet assembly 38 does not engage brake lobe 52. FIG. 8B is a cross-sectional view of braking lever 20 in braking mode, wherein tappet assembly 38 moves to a braking position in engagement with brake lobe 52. Tappet assembly 38 is moved into the braking position by pumping oil into oil cavity 66, which applies hydraulic force to lower clevice 62 (and the rest of tappet assembly 38) to move tappet assembly 38 upwardly against the biasing force of spring 70 as indicated by arrow 78 of FIG. 6B. In this braking mode, roller 56 follows brake lobe 52.

Figure 9:
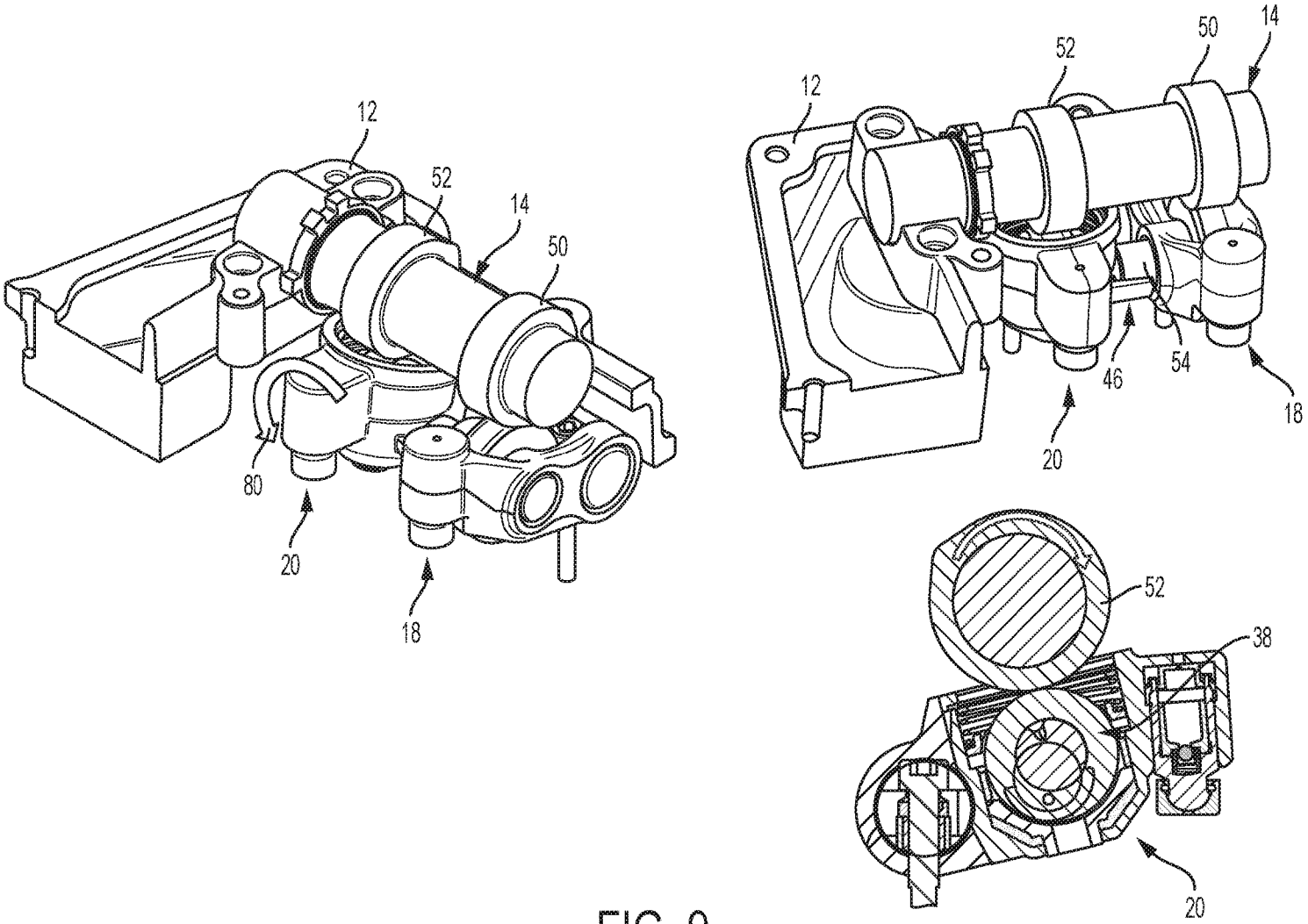
FIG. 9 provides various views of the valve train assembly of FIG. 1 operating in a braking mode such that the brake lever moves independent of the exhaust lever.

FIG. 9 depicts brake lever 20 and exhaust lever 18 during braking operation. In this mode, oil is fed to oil cavity 66 and tappet assembly 38 rises to reach brake lobe 52 (lower right corner of FIG. 9) as described above. Brake lever 20 is then driven by brake lobe 52 profile as brake lobe 52 rotates. When in this braking mode, brake lever 20 actuates the exhaust valve associated with it as it follows brake lobe 52, thereby providing an engine braking function. It should be apparent from the foregoing that exhaust lever 18 remains stationary as brake lever 20 moves in response to brake lobe 52 as indicated by the single arrow 80 of FIG. 9 (upper left corner). This is because as brake lever 20 moves downwardly in response to brake lobe 52, coupling 46 moves away from (or decouples with) extended roller pin 54. Thus, when brake lever 20 is activated (by supplying oil to oil cavity 66), in the same cycle it both follows exhaust lever 18 to actuate an exhaust valve according to exhaust lobe 50 and follows brake lobe 52 to function as a brake lever.

Figure 10B:
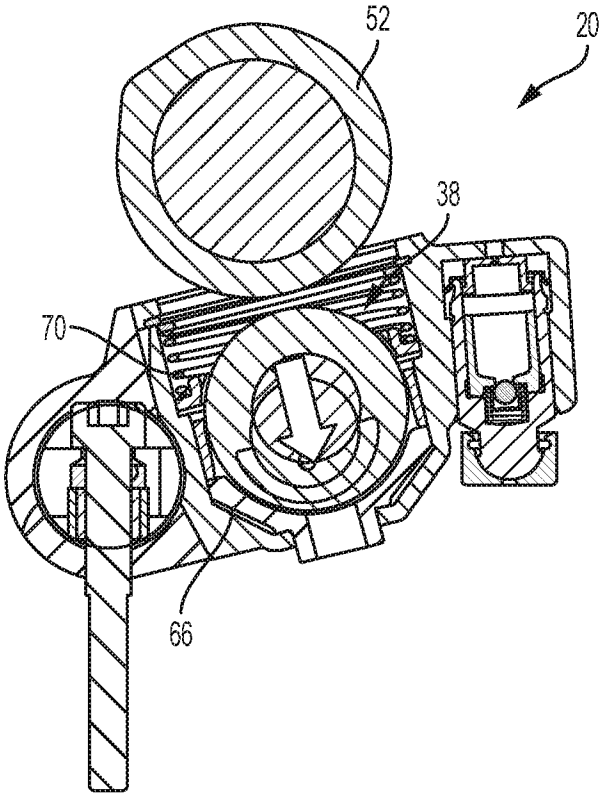
FIG. 10B is a cross-sectional view of the braking lever of FIG. 9 after it has returned to normal mode.
Figure 10A:
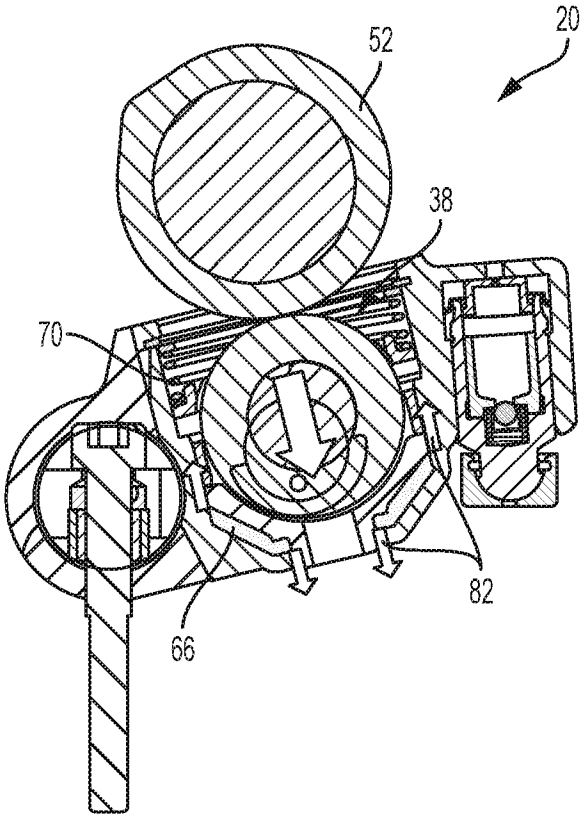
FIG. 10A is a cross-sectional view of the brake lever of FIG. 9 as it exits the braking mode.

FIG. 10A is a cross-sectional view of braking lever 20 as it exits braking mode. FIG. 10B is a cross-sectional view of braking lever 20 after it has returned to normal mode. In FIG. 10A, arrows 82 represent the escape of oil from oil cavity 66. As indicated above, tappet assembly 38 always leaks oil at controlled rate. When sufficient oil is provided to oil cavity 66, tappet assembly 38 stays in engagement with brake lobe 52. When oil is no longer supplied to oil cavity 66, oil cavity 66 continues to leak, and tappet assembly 38 moves downwardly away from brake lobe 52 under the biasing force of spring 70 out of engagement with brake lobe 52 and into the normal mode position as shown in FIG. 10B.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A valve train assembly, comprising:

an exhaust camshaft having an exhaust lobe and a brake lobe;

an exhaust lever mounted adjacent the exhaust lobe; and a brake lever mounted adjacent the brake lobe;

wherein the exhaust lever is coupled to the brake lever to provide simultaneous movement of the exhaust lever and the brake lever in response to the exhaust lobe and independent movement of the brake lever in response to the brake lobe.

2. The valve train assembly of claim 1, wherein the brake lever comprises a coupling having an inner surface and the exhaust lever is coupled to the brake lever when a component of the exhaust lever engages the inner surface.

3. The valve train assembly of claim 2, wherein the brake lever follows motion of the exhaust lever during engine operation based on the component of the exhaust lever engaging the inner surface of the coupling.

4. The valve train assembly of claim 2, wherein engagement of the component with the inner surface of the coupling permits the brake lever to move in tandem with the exhaust lever in response to a roller of the exhaust lever engaging the exhaust lobe.

5. The valve train assembly of claim 4, wherein when the inner surface of the coupling is disengaged from the component, the exhaust lever remains stationary and the brake lever moves independent of the exhaust lever in response to a tappet assembly of the brake lever engaging the brake lobe.

6. The valve train assembly of claim 1, wherein the brake lever comprises a housing and a lower device that forms an oil cavity with the housing, the lower device providing an oil drain.

7. The valve train assembly of claim 6, wherein the brake lever further comprises a tappet assembly that moves to activate the brake lever in response to oil in the oil cavity exceeding a threshold level.

8. The valve train assembly of claim 7, wherein the housing comprises a coupling that engages a pin of the exhaust lever to actuate an exhaust valve and provide an engine braking function based on activation of the brake lever.

9. The valve train assembly of claim 7, wherein the tappet assembly comprises a roller and a roller pin having an opening that provides lubricant to the roller, the lubricant permitting smooth rotation of the roller upon engagement of the roller with the brake lobe.

10. A valve train assembly, comprising:

an exhaust lever mounted adjacent an exhaust lobe; and a brake lever mounted adjacent a brake lobe, the brake lever comprising a tappet assembly;

wherein the exhaust lever couples to the brake lever to provide simultaneous movement of the exhaust lever and the brake lever in response to rotation of the exhaust lobe; and wherein the brake lever moves independent of the exhaust lobe in response to a roller of the tappet assembly engaging the brake lobe.

11. The valve train assembly of claim 10, wherein the brake lever further comprises a housing and a coupling that projects from the housing, and the exhaust lever couples to the brake lever based on engagement with the coupling.

12. The valve train assembly of claim 11, wherein the exhaust lever comprises a pin that extends and projects from the exhaust lever toward the brake lever and engages an inner surface of the coupling.

13. The valve train assembly of claim 10, wherein the brake lever comprises a housing and a lower device that forms an oil cavity with the housing, and wherein the tappet assembly activates the brake lever in response to oil in the oil cavity exceeding a threshold level.

14. The valve train assembly of claim 12, wherein engagement of the pin with the inner surface of the coupling permits the brake lever to move in tandem with the exhaust lever in response to a roller of the exhaust lever engaging the exhaust lobe.

15. The valve train assembly of claim 12, wherein the exhaust lever remains stationary when the inner surface of the coupling is disengaged from the pin such that the brake lever moves independent of the exhaust lever in response to the roller engaging the brake lobe.

16. A method, comprising:

mounting an exhaust lever adjacent an exhaust lobe of an exhaust camshaft;

mounting a brake lever adjacent a brake lobe of the exhaust camshaft, the brake lever comprising a tappet assembly;

engaging a component of the exhaust lever with a coupling of the brake lever to simultaneously move the exhaust lever and the brake lever in response to rotation of the exhaust lobe; and independently moving the brake lever relative to the exhaust lever in response to a roller of the tappet assembly engaging the brake lobe.

17. The method of claim 16, wherein engaging a component of the exhaust lever with a coupling of the brake lever to simultaneously move the exhaust lever and the brake lever causes actuation of at least two exhaust valves in response to rotation of the exhaust lobe.

18. The method of claim 16, wherein independently moving the brake lever relative to the exhaust lever comprises disengaging the coupling of the brake lever from the component of the exhaust lever.

19. The method of claim 16, wherein the brake lever further comprises a housing and a lower device that forms an oil cavity with the housing, and wherein the roller of the tappet assembly engages the brake lobe and activates the brake lever in response to oil in the oil cavity exceeding a threshold level.

20. The method of claim 19, further including, activating an engine braking function of the valve train assembly in response to the tappet assembly being moved to a braking positioning in response to application of a hydraulic force to the lower device.

* * * * *